US011097926B2

(12) United States Patent
Zenier et al.

(10) Patent No.: US 11,097,926 B2
(45) Date of Patent: Aug. 24, 2021

(54) CONNECTOR TO FACILITATE LIFTING OF WEAR PARTS

(71) Applicant: ESCO GROUP LLC, Portland, OR (US)

(72) Inventors: Scott H. Zenier, Portland, OR (US); Christopher M. Carpenter, Tualatin, OR (US); Kevin S. Stangeland, Portland, OR (US)

(73) Assignee: ESCO GROUP LLC, Portland, OR (US)

( * ) Notice: Subject to any disclaimer, the term of this patent is extended or adjusted under 35 U.S.C. 154(b) by 235 days.

(21) Appl. No.: 16/125,636

(22) Filed: Sep. 7, 2018

(65) Prior Publication Data

US 2019/0002248 A1 Jan. 3, 2019

Related U.S. Application Data

(62) Division of application No. 14/326,135, filed on Jul. 8, 2014, now abandoned.

(60) Provisional application No. 61/844,795, filed on Jul. 10, 2013.

(51) Int. Cl.
*B66C 1/66* (2006.01)
*E02F 9/28* (2006.01)

(52) U.S. Cl.
CPC ..... *B66C 1/66* (2013.01); *E02F 9/2883* (2013.01); *E02F 9/2891* (2013.01); *Y10T 29/49764* (2015.01); *Y10T 29/49815* (2015.01); *Y10T 29/49947* (2015.01)

(58) Field of Classification Search
CPC ..... B66C 1/66; E02F 9/2891; E02F 9/2883; Y10T 29/49764; Y10T 29/49815; Y10T 29/49947
USPC ..... 294/215, 89
See application file for complete search history.

(56) References Cited

U.S. PATENT DOCUMENTS

| | | | | |
|---|---|---|---|---|
| 2,867,874 A * | 1/1959 | Larson | F16B 43/02 | 24/115 K |
| D198,281 S * | 5/1964 | Mills | D8/367 | |
| 3,297,293 A * | 1/1967 | Andrews | B66C 1/666 | 248/499 |
| 3,492,033 A * | 1/1970 | Mueller | F16C 11/045 | 403/78 |
| 3,680,906 A * | 8/1972 | Neumeier | B66C 1/66 | 294/89 |
| 5,125,861 A | 6/1992 | Freeman | | |
| 5,732,991 A * | 3/1998 | Tsui | B66C 1/66 | 294/215 |

(Continued)

FOREIGN PATENT DOCUMENTS

| | | |
|---|---|---|
| SU | 523025 | 7/1976 |
| SU | 1735512 | 5/1992 |

(Continued)

*Primary Examiner* — Paul T Chin
(74) *Attorney, Agent, or Firm* — Palmer Dzurella

(57) ABSTRACT

A lifting connector to facilitate the lifting of wear parts used on earthmoving equipment is mechanically secured to a hole in the wear part. The wear part has a latching formation to maintain the head of the connector in a preferred orientation so that it is in the proper service position for connecting the lifting connector to a lifting device. The wear part can be safely maneuvered onto and off of the earthmoving equipment while secured to the lifting device.

15 Claims, 19 Drawing Sheets

(56) References Cited

U.S. PATENT DOCUMENTS

| | | | | | |
|---|---|---|---|---|---|
| D417,139 | S | * | 11/1999 | Pitre | D8/387 |
| 5,992,910 | A | * | 11/1999 | Kwon | B66C 1/66 294/215 |
| 6,467,203 | B2 | | 10/2002 | Pippins | |
| 6,478,350 | B2 | | 11/2002 | Zuliani | |
| 806,407 | A1 | * | 9/2003 | Farrington | B66C 1/66 411/400 |
| 6,986,216 | B2 | * | 1/2006 | Emrich | E02F 9/2883 37/450 |
| 7,299,570 | B2 | * | 11/2007 | Emrich | H03K 17/163 37/455 |
| D605,500 | S | * | 12/2009 | Lee | D8/387 |
| D638,695 | S | * | 5/2011 | Woodrow | D8/382 |
| 8,327,563 | B2 | | 12/2012 | Dingwall et al. | |
| 8,800,178 | B2 | | 8/2014 | Rol Corredor et al. | |
| 9,193,570 | B2 | * | 11/2015 | Norpoth | B66C 1/66 |
| 2003/0180118 | A1 | * | 9/2003 | Alba | B66C 1/66 411/400 |
| 2010/0162594 | A1 | | 7/2010 | Bierwith | |

FOREIGN PATENT DOCUMENTS

| | | |
|---|---|---|
| WO | WO 2006/130989 | 12/2006 |
| WO | WO 2008/021376 | 2/2008 |
| WO | WO 2010/089432 | 8/2010 |

* cited by examiner

CONNECTOR TO FACILITATE LIFTING OF WEAR PARTS

RELATED APPLICATION

This application is a divisional of pending application Ser. No. 14/326,135, filed Jul. 8, 2014, which claims priority to U.S. Provisional Patent Application No. 61/844,795, filed Jul. 10, 2013, both entitled "Connector to Facilitate Lifting of Wear Parts." Each of these applications are incorporated by reference herein in its entirety and made a part hereof.

FIELD OF THE INVENTION

The present invention pertains to a connector to facilitate the lifting of heavy loads, and in particular wear parts for earthmoving equipment.

BACKGROUND OF THE INVENTION

In mining and construction, wear parts (e.g., teeth, shrouds, and blades) are commonly provided along the digging edge of excavating equipment such as buckets for dragline machines, cable shovels, face shovels, hydraulic excavators, graders, dozers, and the like. The wear parts protect the underlying equipment from undue wear and, in some cases, also perform other functions such as breaking up the ground ahead of the digging edge. During use, the wear parts typically encounter heavy loading and highly abrasive conditions. As a result, they must be periodically replaced.

These wear parts usually comprise two or more components such as a base that is secured to the digging edge, and a wear member that mounts on the base to engage the ground. The wear member tends to wear out more quickly and is typically replaced a number of times before the base must also be replaced. One example of such a wear part is an excavating tooth that is attached to the lip of a bucket for an excavating machine. A tooth typically includes an adapter secured to the lip of a bucket and a point or wear member attached to the adapter to initiate contact with the ground. A pin or other kind of lock is used to secure the wear member to the adapter.

These wear parts are heavy and cannot be easily lifted. New wear parts are typically designed with cast lifting eyes integrally connected to the wear parts. As the wear parts contact the material to be excavated the integral lifting eyes are worn away leaving no way to gain an attachment point on the worn wear part. To remove the worn wear part some operators simply let the parts fall to the ground when the lock is removed, or use a hammer to knock the wear part from the base if fines prevent the release of the components. The uncontrolled falling of the wear part and the use of a hammer subject the operators to risks. Moreover, the operators are still left with needing to move the wear parts from the ground to a discard pile or bin. Another common way to remove the worn wear parts is with a complex rigging arrangement using chains, straps, or other mechanisms to secure the wear part. However, during removal, the installer can still be in potential risk if the rigging arrangements are unsecure and slip or create pinch points. Additionally rigging arrangements that require chains, straps, or other mechanisms to go under the worn wear parts can be problematic when rigging is removed. Once the wear part is moved to the discard pile the rigging arrangements may be under the wear part requiring the operator roll or move the worn wear part to remove the rigging arrangement. Another alternative way to maneuver the worn wear part is to weld a lifting ring onto the part. This is not desirable because mobile welding equipment is needed at the machine site. Welding on site is prohibited at many mine sites as welding imposes a risk of injury. In addition, wear parts tend to be composed of very hard steel which requires a careful and time consuming process to achieve a high quality weld. If there is a poor weld the lifting eye may be separated from the wear part causing uncontrolled movement of the wear part. These kind of removal requirements increase the amount of downtime required to replace wear parts and decreases productivity.

SUMMARY OF THE INVENTION

The present invention pertains to a connector to facilitate connecting of a load to a lifting device. With the present construction, the connector allows the installer to utilize various approved forms of rigging for maneuvering the wear part quickly and safely without complex rigging arrangements that require chains, straps, or other mechanisms to go under the worn wear parts. The orientation of the wear part does not dictate the safety of the removal environment, the connector allows the wear part to be installed and removed safely in any convenient orientation.

In accordance with one aspect of the invention, a lifting connector has a head for connecting to a lifting device, and a base that creates a positive engagement with a hole within the wear part for securing the connector to the wear part.

In accordance with another aspect of the invention, the connector is positively secured within a preformed hole provided for receiving the lock to hold the wear member in place during use. In one preferred construction, the connector uses the same methods and features utilized by the lock to secure the connector to the wear part but other holes are possible.

In accordance with another aspect of the invention, the connector has a head in the form of an eye and a base in the form of a shank with threads to form a positive engagement with complementary threads on the wear part or an insert or collar secured to the wear part.

In another aspect of the invention, a wear part for earthmoving equipment includes a mechanically attached lifting connector (e.g., a lifting eye) for attachment to lifting equipment. For example, the wear part includes a preformed hole and the connector is secured within the hole to facilitate connection to a lifting device for installation and/or removal.

In accordance with another aspect of the invention, the mechanically attached lifting connector is installed in the wear part at the time of manufacture so that the mechanical lifting connector is shipped, stored, and installed as an integral part of the wear part.

In accordance with another aspect of the invention, the connector has a recess in the base for housing a biased latching tooth to secure the connector in a locked position to maintain the head in a preferred orientation.

In accordance with another aspect of the invention, the connector gives haptic and audible feedback once the connector is properly engaged with the wear part.

In accordance with another aspect of the invention, the connector can be utilized to lift certain wear parts with a single hole within the wear part.

In accordance with another aspect of the invention, the connector is secured to a wear part in cooperation with the lock or lock component.

In accordance with another aspect of the invention, the connector base secures multiple wear parts together allowing the parts to be removed in an assembled state.

In accordance with another aspect of the invention, a plug minimizes the fines that can enter preformed holes in the wear parts when connectors are not in use.

Another aspect of the invention pertains to a novel process for installing and/or removing wear parts onto or from earthmoving equipment safely and easily. In this process, a connector with a base is positively secured into a preformed hole in the wear part (such as a hole for receiving a lock or a hole specifically designed for receipt of the connector). The connector has a head with means (e.g., an eye) for connecting to lifting equipment. The lifting equipment is operated to maneuver the wear part onto or off of the earthmoving equipment.

In a preferred process, one or more connectors are positively secured into preformed holes within one or more wear parts. The connectors have a load bearing structure for connecting to lifting equipment. The lifting equipment is operated to maneuver one or more wear parts onto the earthmoving equipment. While the wear parts are still secured to the lifting equipment the wear parts are secured to the earthmoving equipment.

In another preferred process, the connector remains within the wear part during the digging operation to prevent fines from entering a hole within the wear part. As the wear part and connector wear down to expose a hole on the axis of the connector. The connector is removed from the wear part with a tool that matches the shape of the blind hole. A new lifting eye is installed within the hole to maneuver the worn wear part.

In another aspect of the invention, a wear part is manufactured by (1) casting or forging a wear part body having a mounting configuration to facilitate its attachment to earthmoving equipment, a wearable surface, and a hole, and (2) subsequently securing a lifting connector (e.g., a lifting eye) within the hole by mechanical attachment.

In one preferred construction, the connector is a lifting eye with a load bearing ring as the head, and a threaded shank as the base for securing into a hole in the wear part. The threads or partial threads can be formed in the hole of the wear part or by an insert secured in the hole. In other embodiments, heads with other load bearing lifting structures can be used, and/or other bases that securely hold the connector to the part for lifting, i.e., without fear of the connector disengaging or shifting significantly in the wear part.

To gain an improved understanding of the advantages and features of the invention, reference may be made to the following descriptive matter and accompanying figures that describe and illustrate various configurations and concepts related to the invention.

DETAILED DESCRIPTION OF THE PREFERRED EMBODIMENTS

Figure 1:
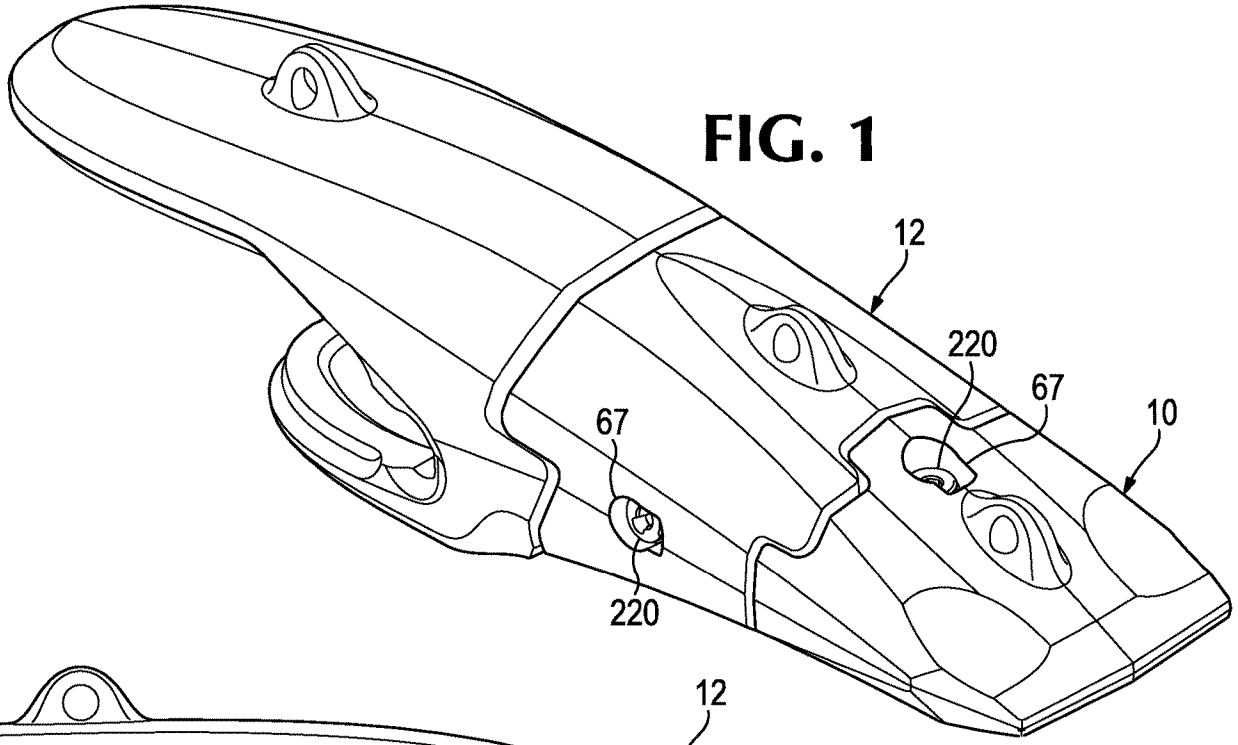
FIG. 1 is a front perspective view of an example wear assembly including an adapter, intermediate adapter and wear member.
Figure 2:
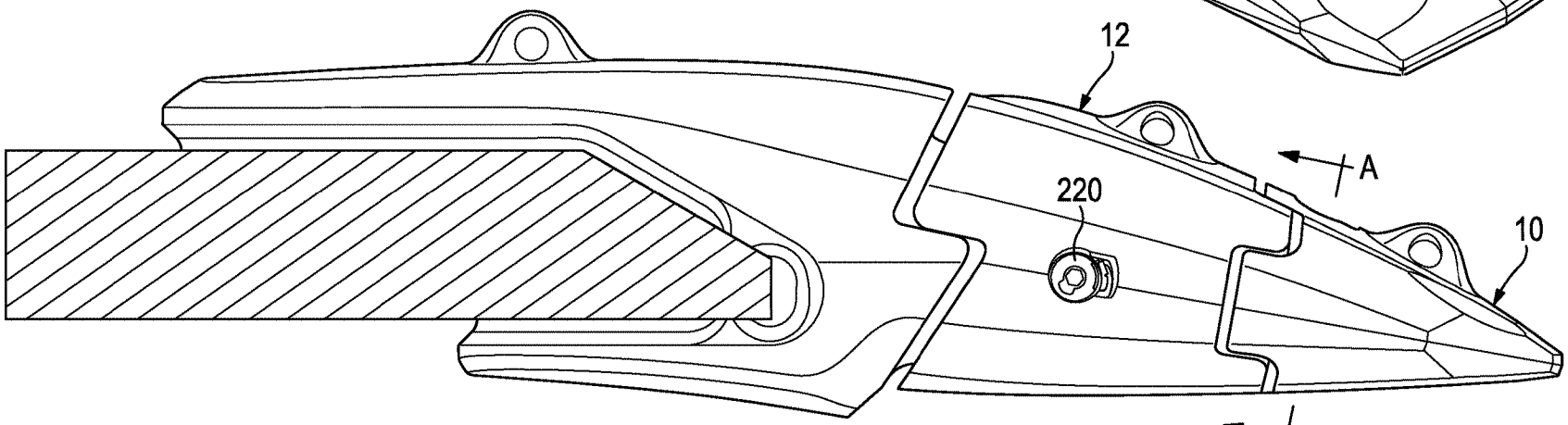
FIG. 2 is a side view of the wear assembly of from FIG. 1 attached to a lip.
Figure 3:
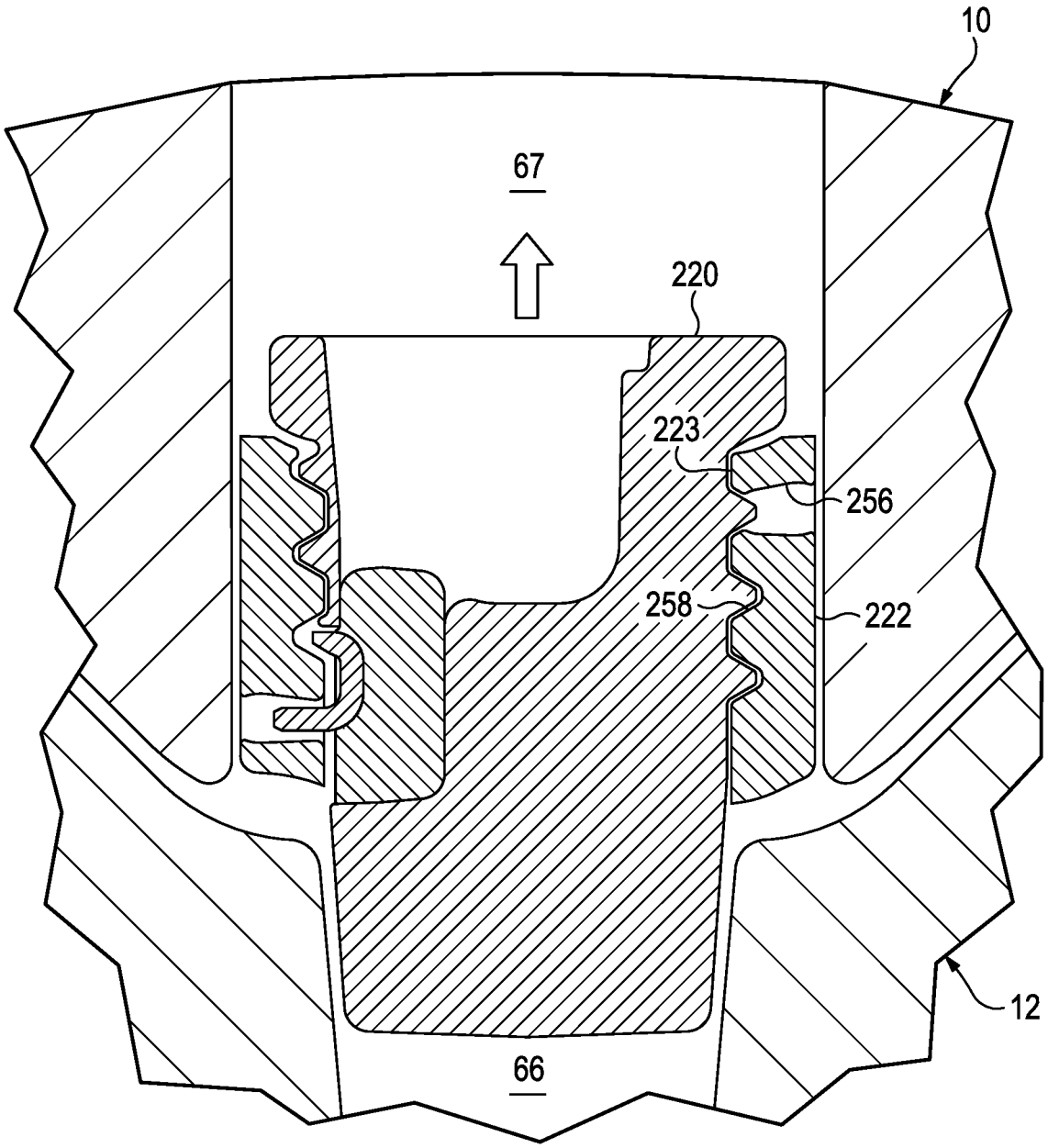
FIG. 3 is a partial cross-sectional view taken along line A-A in FIG. 2 with the lock in the locked position.
Figure 4:
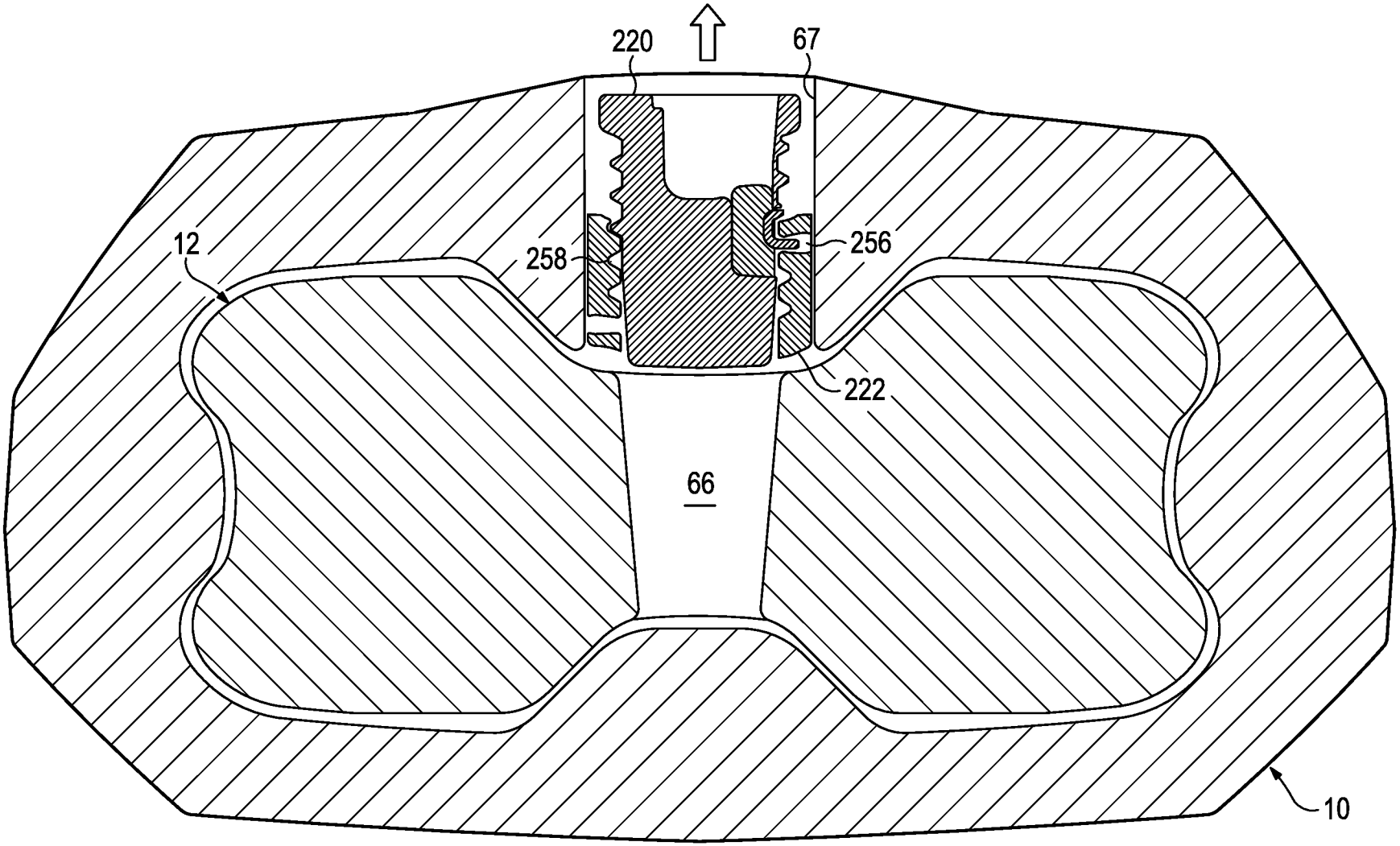
FIG. 4 is a cross-sectional view taken along line A-A in FIG. 2 with the lock in the release position.
Figure 5:
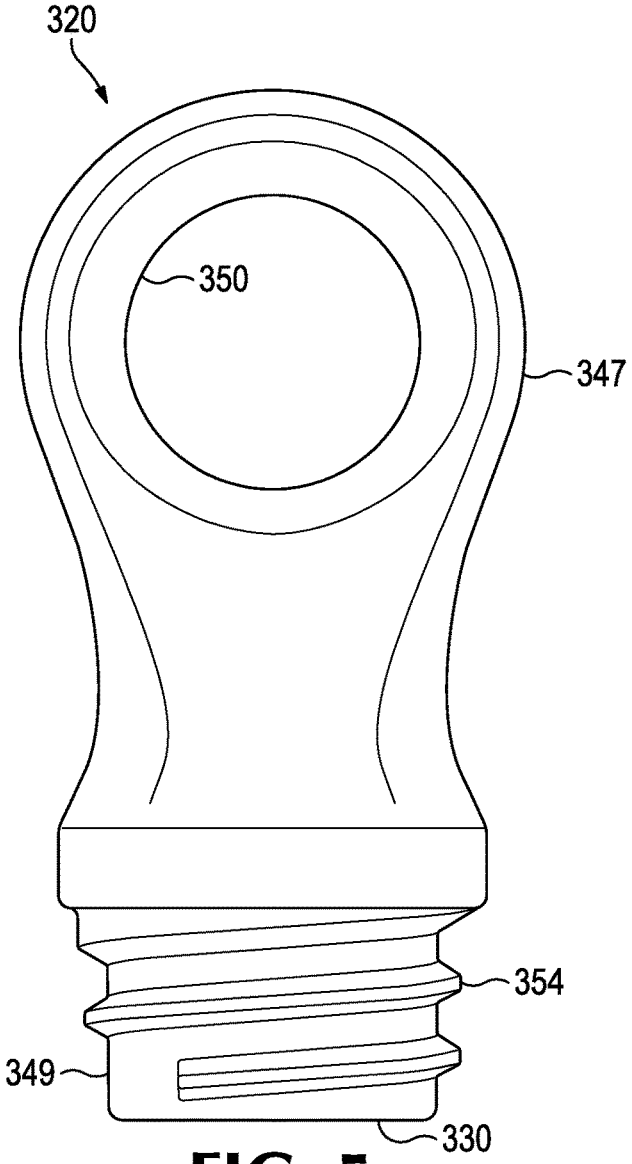
FIG. 5 is a front view of a connector of the present invention in the form of a lifting eye.

The present invention pertains to a connector to facilitate the lifting of heavy parts (such as wear parts) for earthmoving equipment by a lifting device. The lifting device may be, for example, a hoist, a crane, a robot, or other known lifting devices used to lift wear parts. The inventive aspects of the present invention are described in this application in relation to a lifting eye for use with a worn wear part used for earth working equipment. Further, in this application, relative terms are at times used, such as front, rear, up, down, horizontal, vertical, etc., for ease of the description. Nevertheless, these terms are not considered absolute; the orientation of a lifting eye can change considerably depending on the part to be lifted. These relative terms should be understood with reference to the orientation of connector 320 as illustrated in FIG. 5 unless otherwise stated. In all figures, like components use similar numbering.

In accordance with a first embodiment of the invention shown in FIGS. 5-16, lifting connector 320 includes a head 347 and a base 349. In one example, connector 320 is in the form of a lifting eye and base 349 is in the form of a shank (FIGS. 5-8). Head 347 comprises a load bearing ring 350 extending upward from base 349 for receipt of and connecting to approved rigging (not shown). The load bearing ring 350 allows the installer to utilize various approved forms of rigging for maneuvering the wear part quickly and safely without complex rigging arrangements. The ring 350 could be replaced with other rigging engaging elements such as a plate with a hole, a c-shaped loop with a spring loaded gate, a threaded socket, or an adapter that can be gripped by or otherwise secured to the lifting device.

Figure 6:
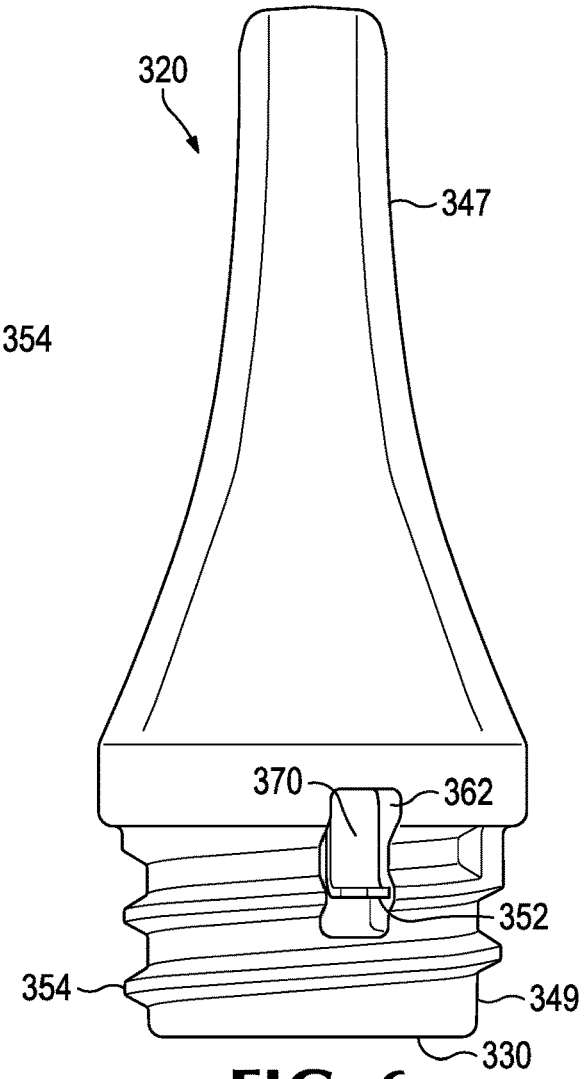
FIG. 6 is a side view of the lifting eye from FIG. 5.
Figure 7:
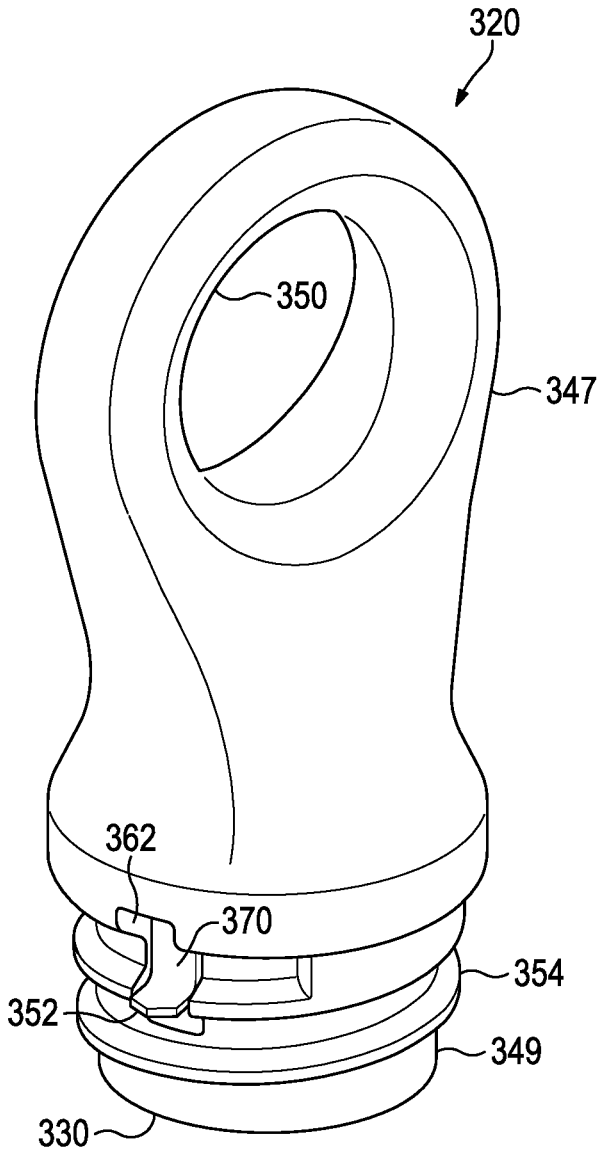
FIG. 7 is a front perspective view of the lifting eye from FIG. 5.
Figure 8:
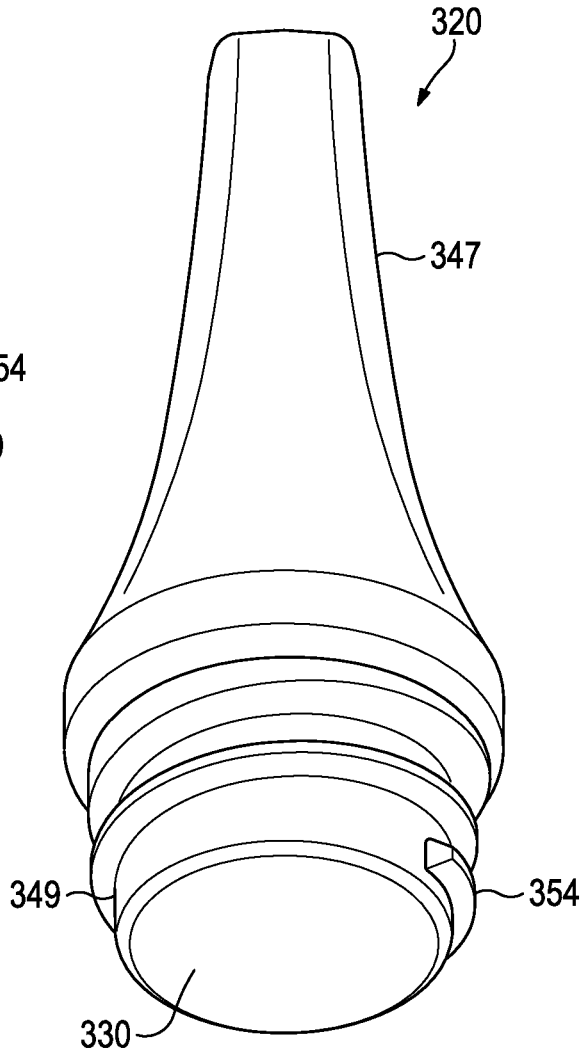
FIG. 8 is a bottom perspective view of the lifting eye from FIG. 5.
Figure 9:
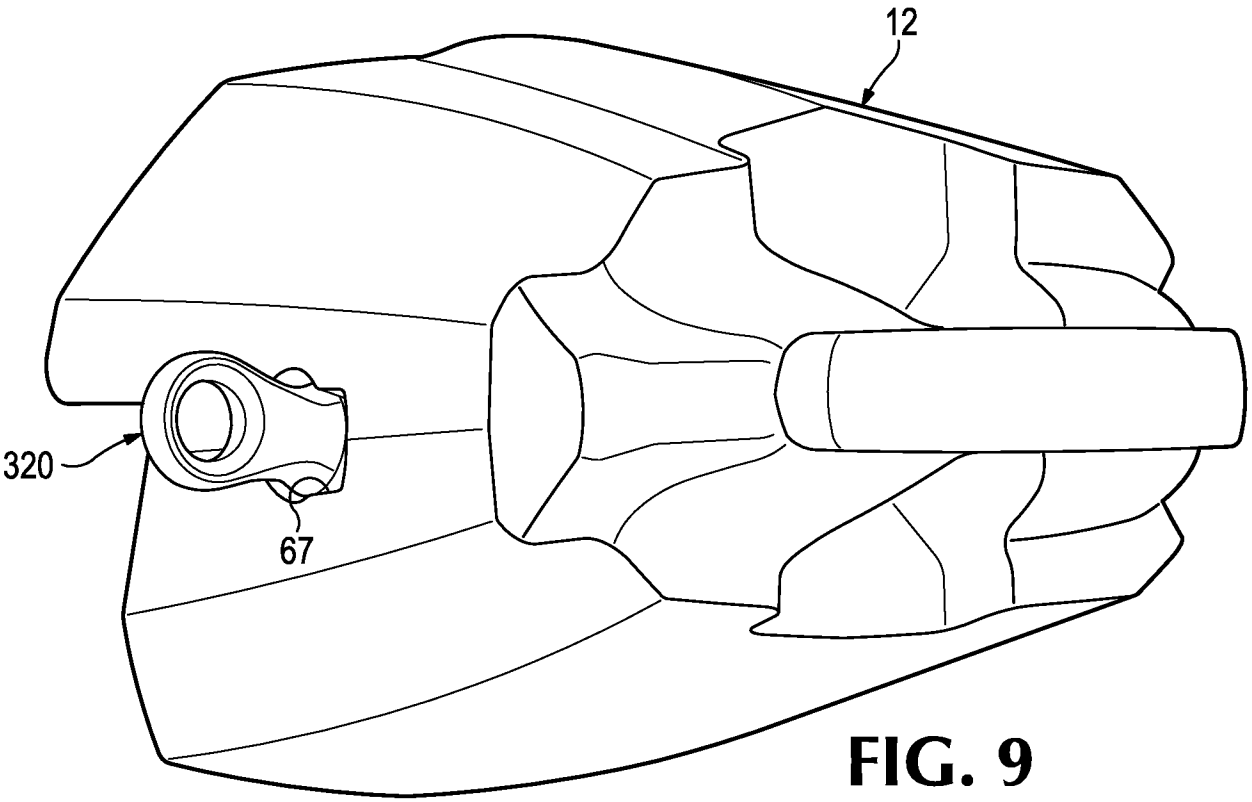
FIG. 9 is a bottom perspective view of a lifting eye installed in an intermediate adapter.
Figure 10:
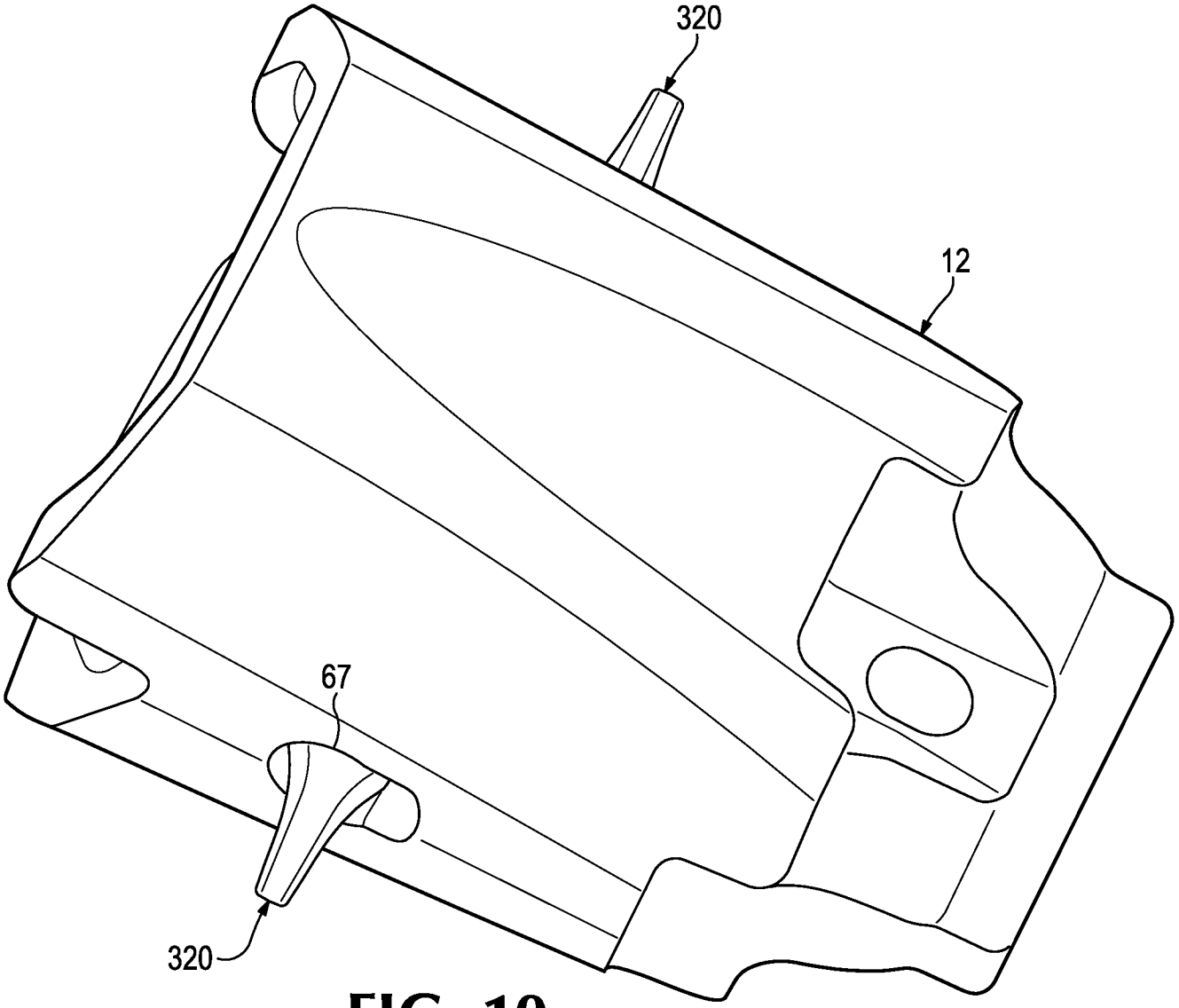
FIG. 10 is a top perspective view of the lifting eye and intermediate adapter from FIG. 9.
Figure 11:
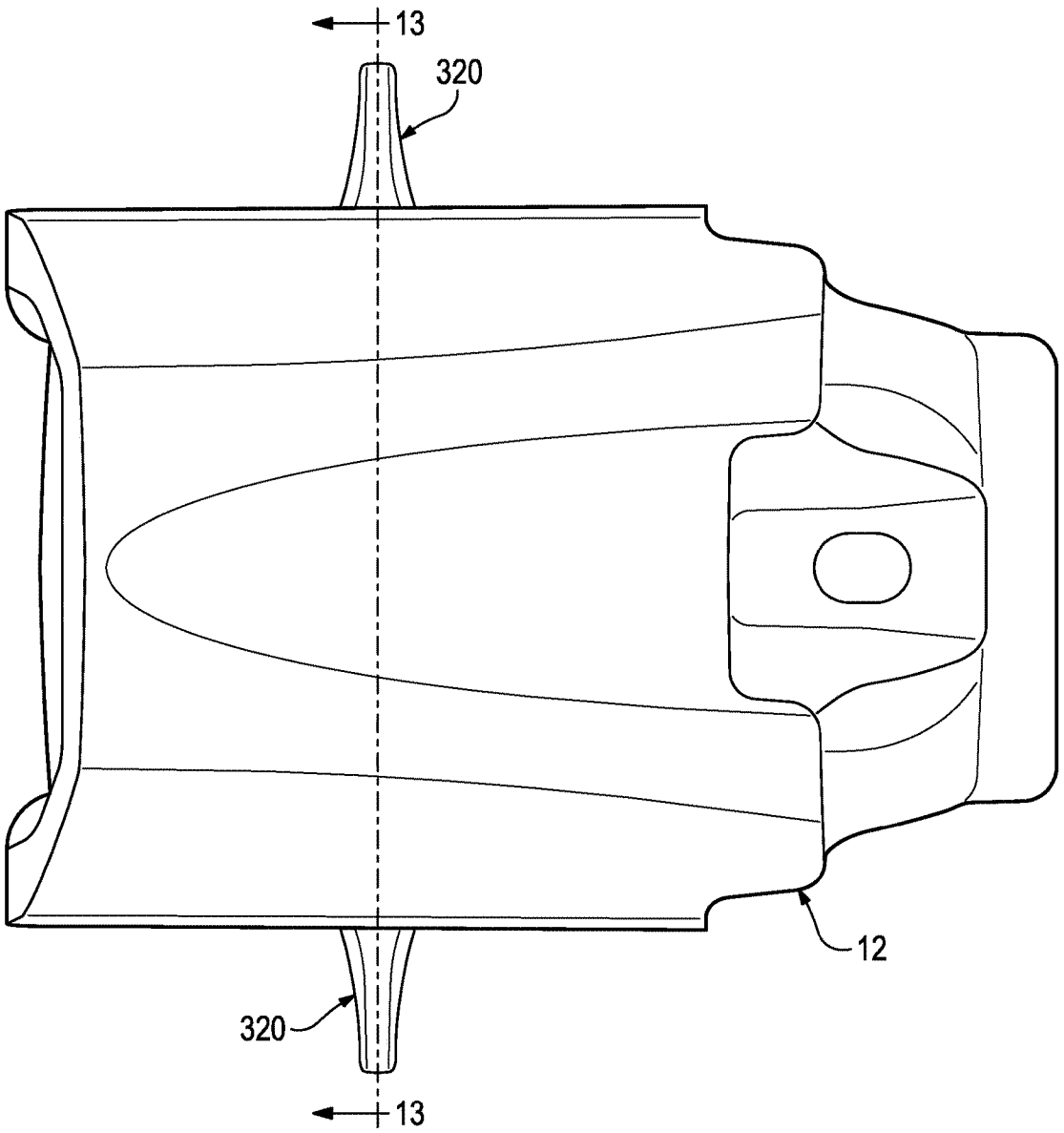
FIG. 11 is a top view of the lifting eye and intermediate adapter from FIG. 9.
Figure 12:
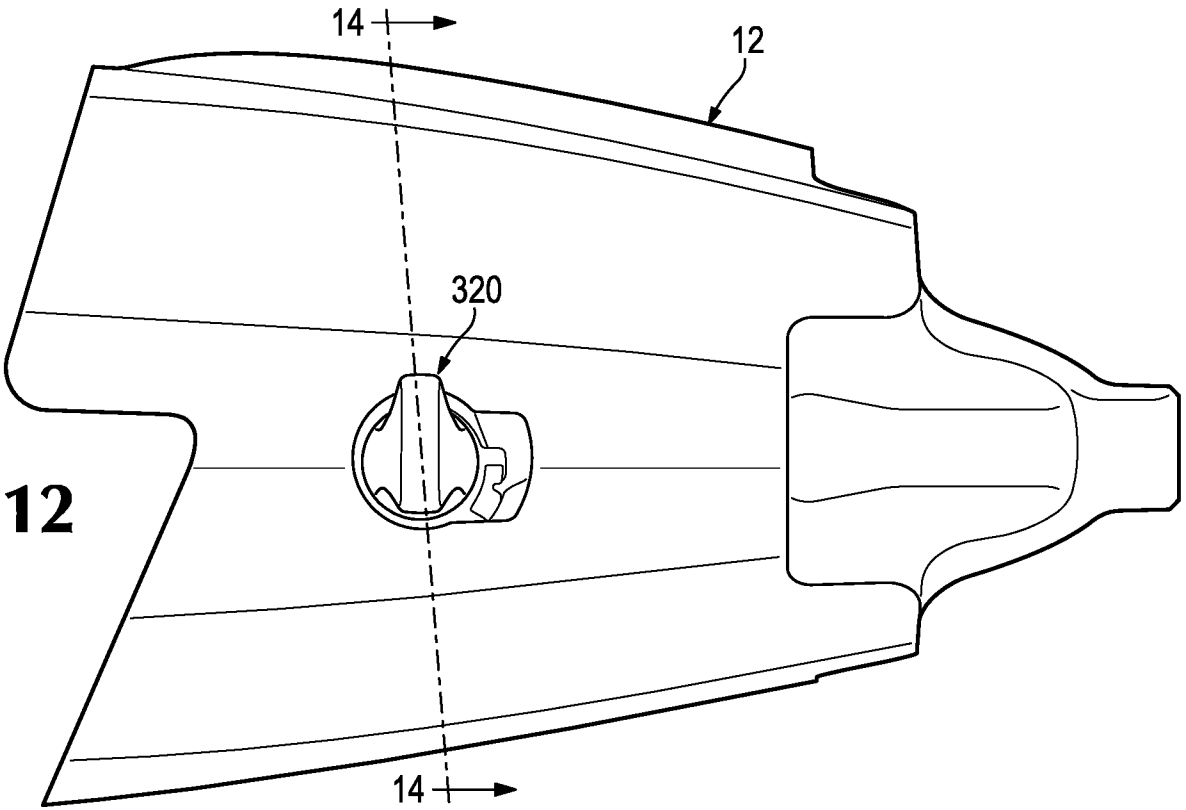
FIG. 12 is a side view of the lifting eye and intermediate adapter from FIG. 9.
Figure 13:
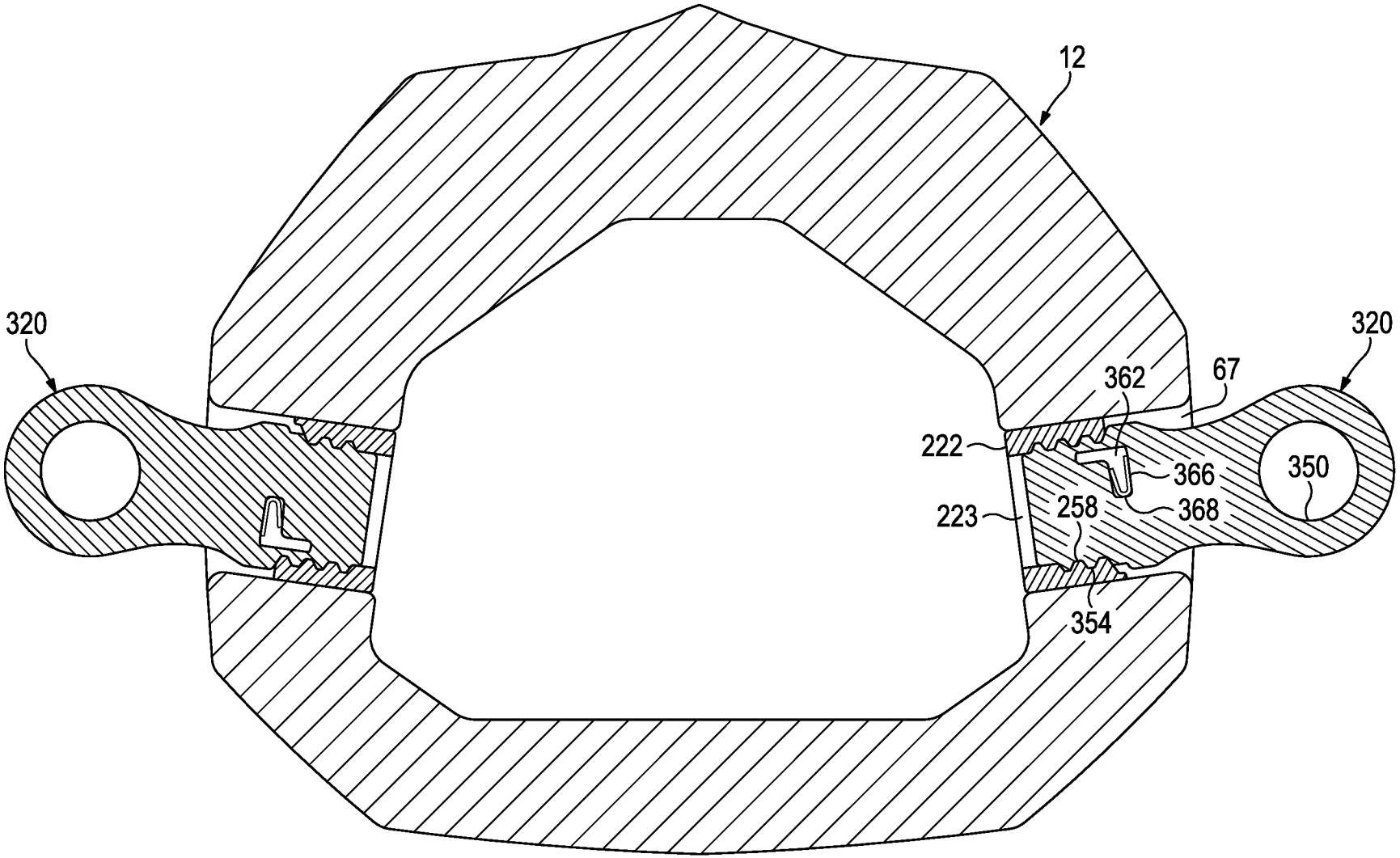
FIG. 13 is a cross-sectional view taken along line 13-13 in FIG. 11.
Figure 14:
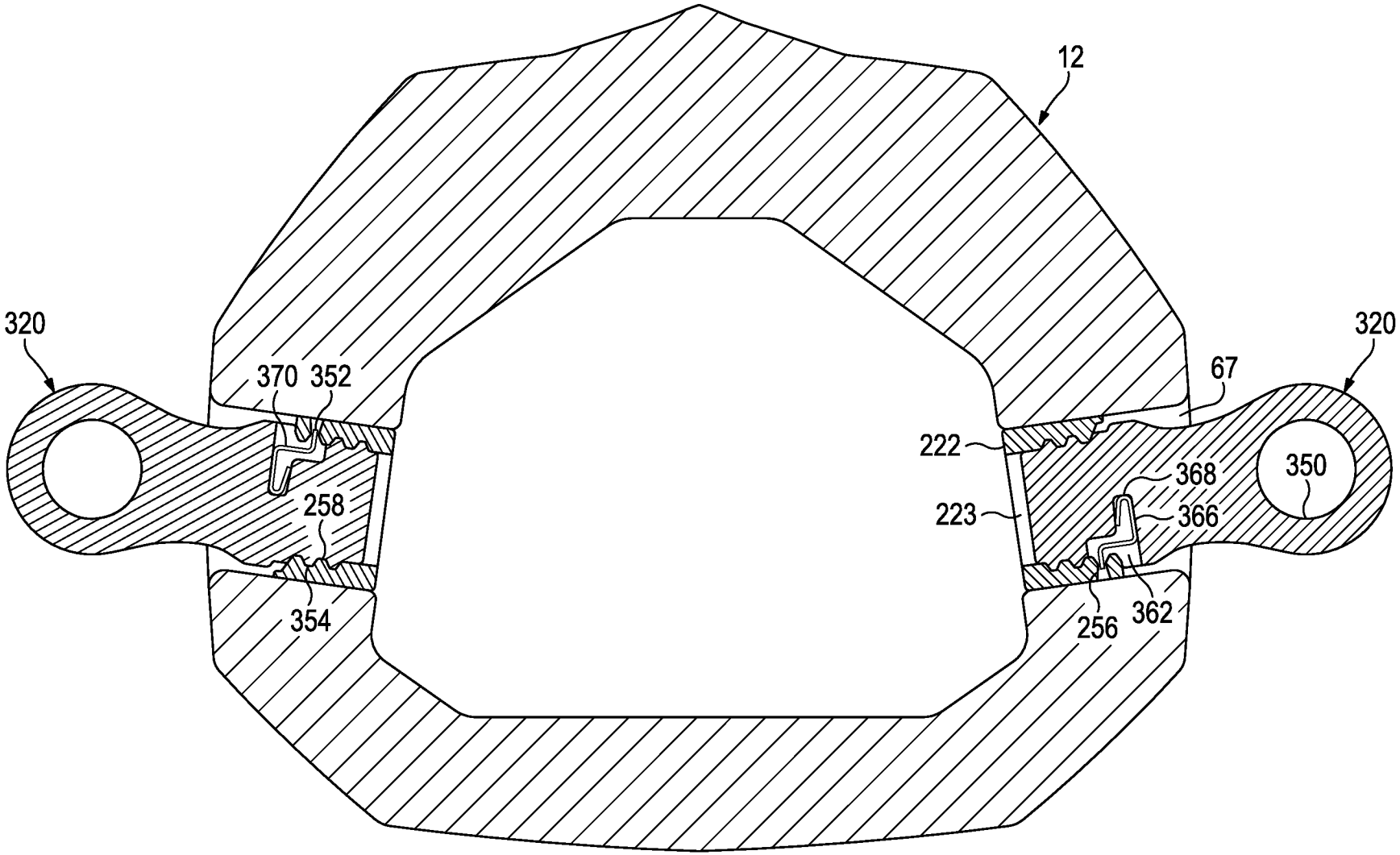
FIG. 14 is a cross-sectional view taken along line 14-14 in FIG. 12.
Figure 15:
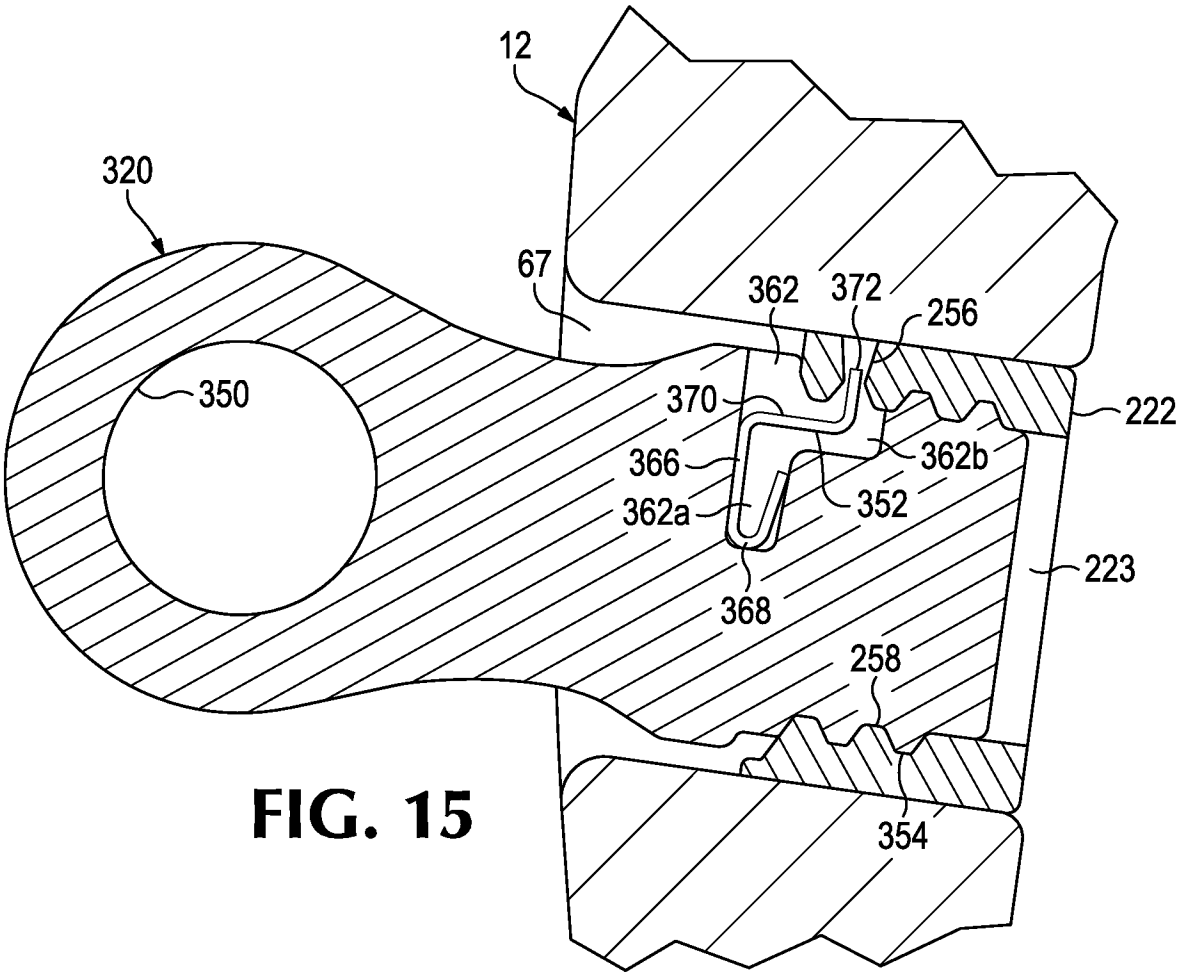
FIG. 15 is a partial cross-sectional of the lifting eye and wear assembly from FIG. 14.
Figure 16:
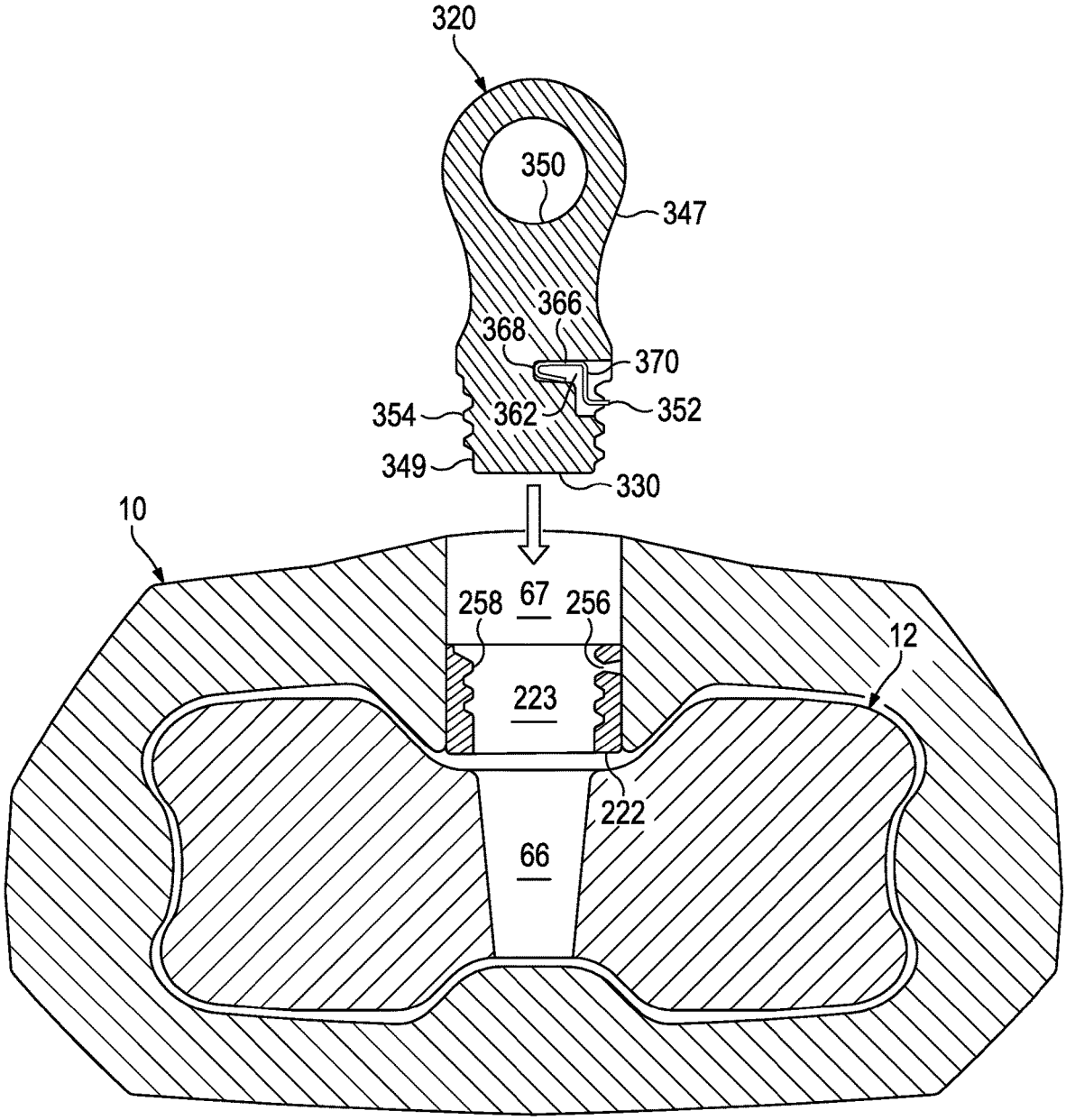
FIG. 16 is a cross sectional view taken along line A-A in FIG. 2 with the lifting eye ready for installation.

Base 349 extends downward from head 347. Preferably a securement mechanism in the form of threads 354, or another means for positively engaging the wear part, extend along the length of base 349. Threads may extend the entire length of base 349 or along only a portion of the base 349. In this embodiment, L shaped recess 362 is located near the end of the thread on connector 320 at the bottom of head 347 (as seen in FIG. 15 FIGS. 5-8 and 16) though other locations are possible. Recess 362 opens in one side of threads 354 as can be seen in FIGS. 6 and 14-16. Recess 362 is oriented just offset from the central plane of the ring as can be seen in FIGS. 6 and 15 but it could have other orientations. A latching detent 352 is placed in recess 362 and biased to protrude beyond the surrounding threads 354 (FIGS. 7, and 14-16).

Latching detent 352 includes a body 366, a U-shaped base 368, and a step 370. Detent 352 is preferably held in place within recess 362 of base 349 with an interference fit. Alternatively detent 352 may be held in place within recess 362 with an elastomer (e.g., rubber member), adhesive, mechanical connector, or other means (not shown). Base 368 of latching detent 352 is bent into a hook and is received in the narrow inner portion 362*a* of recess 362 (FIG. 15). The hook is slightly longer and flexes to bear against the inner portion 362*a* of recess 362. This engagement keeps latching detent 352 in proper location relative to thread 354. Step 370 supports the free end 372 of latching detent 352, while allowing compression of latching detent 352 into recess 362. The larger portion 362*b* of recess 362 provides a clearance for the inward flexing of detent 352. A foam, silicone, or other kind of compressible elastomer (not shown) could be fit into the larger recess portion 362*b*, behind step 370 of detent 352 to avoid a fines build up resisting depression and/or to provide more outward bias. Detent 352 is preferably formed of sheet steel, but could be formed of other materials.

Wear parts in the form of points, intermediate adapters, adapters, shrouds, plates, and the like are cast or forged with a mounting configuration to facilitate its attachment to earthmoving equipment, and a wearable surface. Wear parts may have one or more holes 67 and, in this example, collars 222 within the wear part such as disclosed in U.S. patent application Ser. No. 13/547,353 filed Jul. 12, 2012 incorporated herein by reference. In a preferred embodiment, collar 222 fits in hole 67 of a wear part and includes a bore or opening 223 with a securement mechanism 258 in the form of threads for receiving complementary threads 254 of lock 220, but other securement mechanisms besides threads are possible. Hole 67 and collar 222 may be in a wear member 10 (FIGS. 1-4 and 16), an intermediate adapter 12 (FIGS. 1 and 9-15), an adapter, shroud (FIG. 21), or other wear part. The collars 222 may be installed in the wear part at the time of manufacture so that they remain secured to the wear part throughout the life of the wear part or they may be installed in the wear part when the part is installed on the excavating equipment. The collar could be a part of the lock provided to releasably hold the wear part to the base or could be a component separate from any lock. The collar could alternatively be omitted and threads or partial threads formed in hole 67. Holes 67 are adapted to receive a lock to secure the wear member to the earthmoving equipment.

Figure 21:
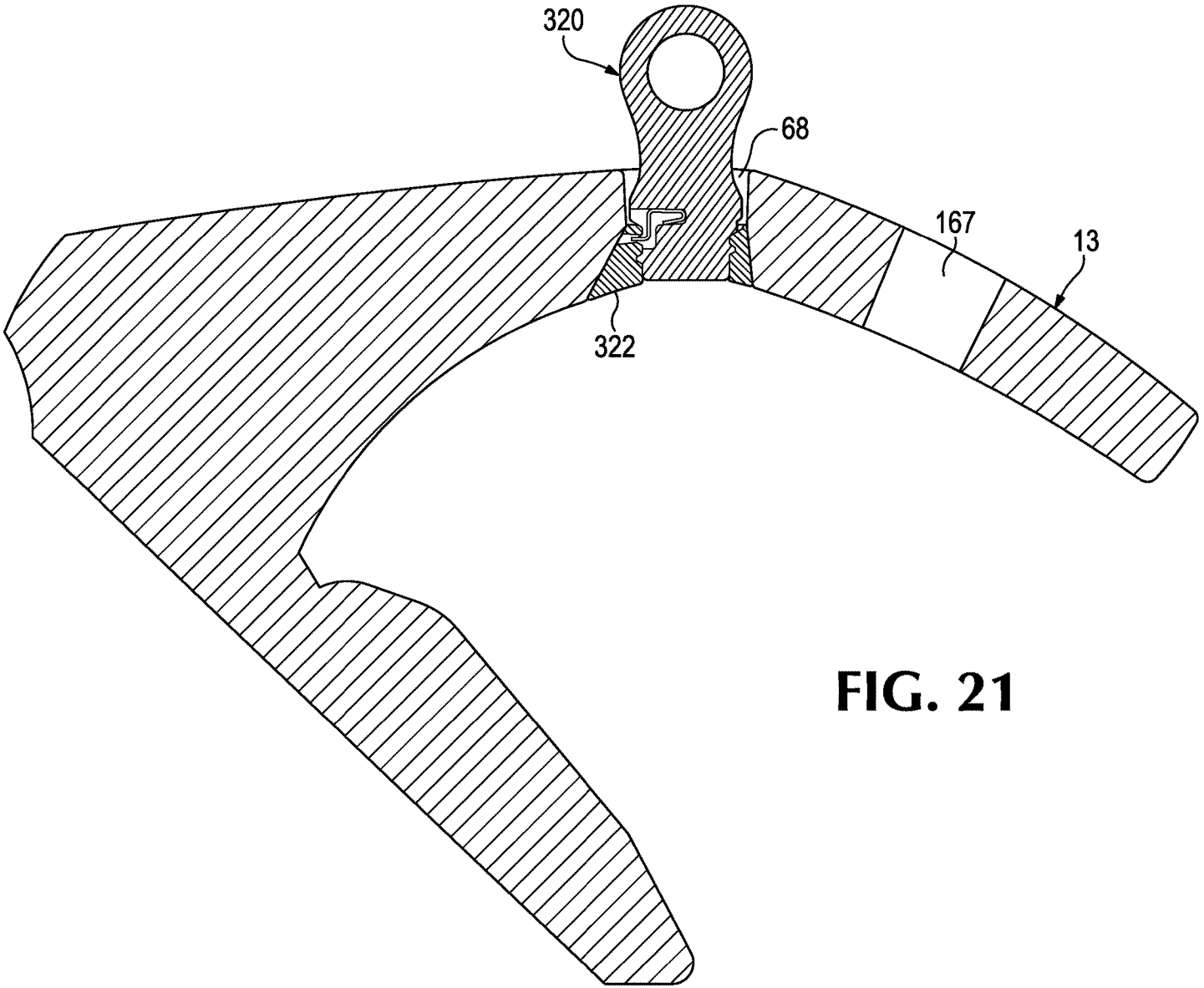
FIG. 21 is a side view of an example wear part in the form of a shroud of the present invention.

In addition to hole 67, wear parts may contain one or more holes 68 specifically provided for receiving a mechanical lifting connector. Hole 68 can be the same as hole 67 and could be fitted with a collar 222 or could have another securement mechanism (e.g., threads or partial threads) formed within hole 68. The hole(s) receiving the locks 67 could be different from the hole(s) receiving the lifting connector 68 and the collars for receiving the lock to secure the wear member to the earthmoving equipment may be different than the collars used with the lifting connector 320. A wear member with a hole to mechanically attach a lifting connector or lifting eye is easier to manufacture and cost less to manufacture than a wear member with an integral cast or forged lifting eye. Often as wear members with integral cast lifting eyes are cast, the lifting eyes cool faster than the body of the wear part. This can lead to a variety of casting quality problems. In one example, shroud 13 has one retainer keyway 167 for receiving a lock and one hole 68 for receiving a collar 322 and mechanical lifting connector 320 (FIG. 21). Collar 322 is similar to collar 722 which is discussed below. Connector 320 can be used along with approved rigging equipment and a lifting device to maneuver the wear part onto excavating equipment as will be discussed below.

Figure 22:
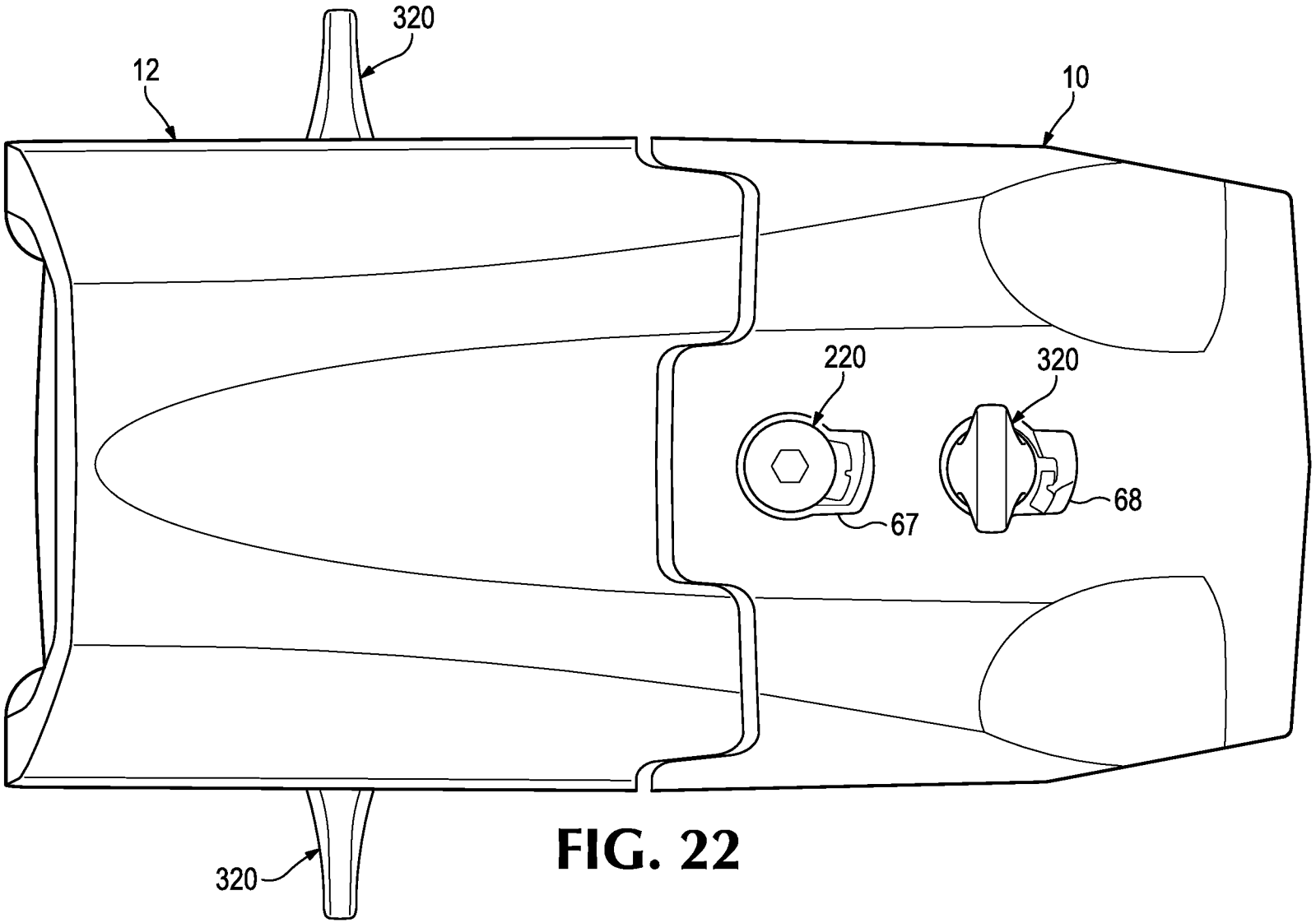
FIG. 22 is a top view of an example wear assembly including an intermediate adapter and wear member with one embodiment of a lifting connector installed in preexisting holes.

Connector 320 is positively secured to a wear part utilizing preexisting holes 67 and/or 68 (FIG. 22). In this example, collars 222 within the wear part fit in holes 67 and/or 68 of wear member 10 and includes a bore or opening 223 with threads 258 for receiving complementary threads 354 of connector 320 (FIGS. 1-4 and 9-16), but other securement mechanism are possible. Single or multiple lifting eyes and rigging equipment can be used to manipulate the wear member 10, intermediate adapter 12, adapter, shroud 13, and the like. The collar could alternatively be omitted and could be a component of the lifting eye if not already in the wear part. Alternatively, the base could be configured to be secured in the hole in the same way as the collar.

In use, locking pin 220 is removed from the wear part and connector 320 is installed in the former location of locking pin 220 (FIGS. 1-4 and 9-16). If two locks are used, one lock is preferably changed at a time as discussed below. Utilizing the existing hole 67 and collar 222 helps ensure that the lifting eye will be installed in an area protected from wear so that base 349 can be securely connected to the wear part in a location that will provide adequate strength for lifting. Utilizing an existing hole where the lock was located also minimizes the amount of fines cleanout needed for installation of connector 320 and maintains minimal holes in the wear part that might weaken the strength during normal operation. However, another hole on the wear part could be specifically designed for receipt of the lifting eye. Connector 320 is installed into collar 222 within the wear part from outside the wear part so that base end 330 is the leading end and securement mechanism 354 engages securement mechanism 258 (i.e., threads 354 of connector 320 engage collar threads 258).

A latching formation in the form of an outer pocket or recess 256 is preferably formed in the thread 258 of collar 222 to receive detent 352. In alternative embodiments, the recess may be the connector 320 and the detent may be in the collar. As connector 320 reaches an end of travel within collar 222 there is a noticeable "click" or "thunk" as detent 352 is engaged in outer pocket 256. The "click" provides audible and haptic feedback to a user that helps a user determine that connector 320 is fully latched in the proper service position. This audible feedback results in more reliable installations using the present combined collar and lifting eye, because an operator is trained to easily identify the audible feedback as verification that connector 320 is in the desired position to maneuver the wear member 10. Unlike traditional threaded lifting eyes, the use of a detent 352 enables connector 320 to stop at a fixed position with a predetermined orientation relative to collar 222. Further, the latching formation maintains the connector in a preferred orientation so that if the wear part spins while secured to the lifting device the latching formation of connector 320 ensures that the wear part does not rotate or otherwise become separated from the connector (i.e., the latching formation prevents the connector 320 from rotating further into or out of the collar 222 as the wear part is lifted with the lifting device). Detent 352 also keeps connector 320 outside of hole 66 with sufficient clearance, so that the wear part can be removed (and installed). Other kinds of detents could be used that latch in other ways such as to engage the inner wall of the wear member cavity. Once connector 320 is fully latched in the proper service position, approved forms of rigging are attached to head 347 and connected to lifting equipment. The lifting equipment can maneuver the wear part onto or off of the earthmoving equipment in a controlled manner without the fear of connector 320 disengaging or shifting significantly in the wear part.

The above is a preferred embodiment of the invention. Other arrangements are possible. Other embodiments can include bases that have wear part engagement means with bearing surfaces besides threads. For example, the base can have other latches, jaws, flanges, or the like that positively engage and grip the preformed hole in the wear part and/or the surfaces adjacent the hole such that the connector is firmly held to the wear part to be removed or installed if there is no pre-existing lifting eye. The base could include grips that engage the inner wall of the wear part and pull a rim against the outer surface of the wear part (or vice versa). The base could include projections that fit within recesses in the wear part. The base could include grips that press outward against the peripheral wall of the hole. These are but examples and other arrangements could be used to positively engage the wear part.

Figure 17:
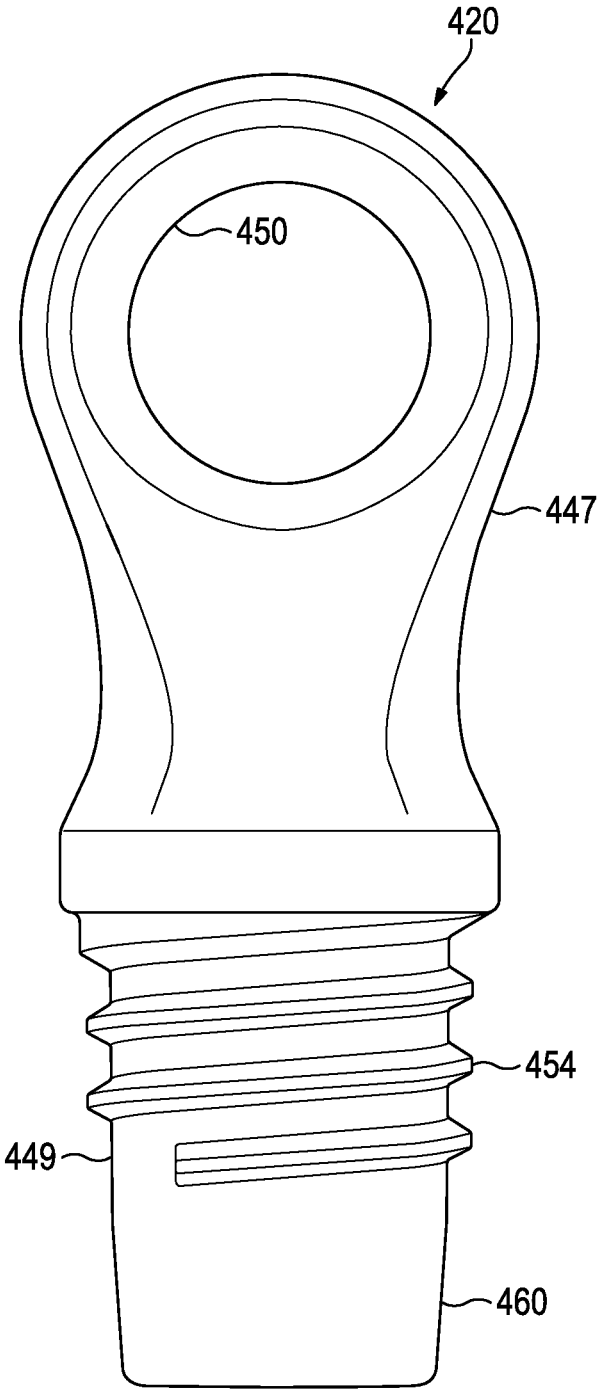
FIG. 17 is a front view of an alternative connector of the present invention in the form of a lifting eye.
Figure 18:
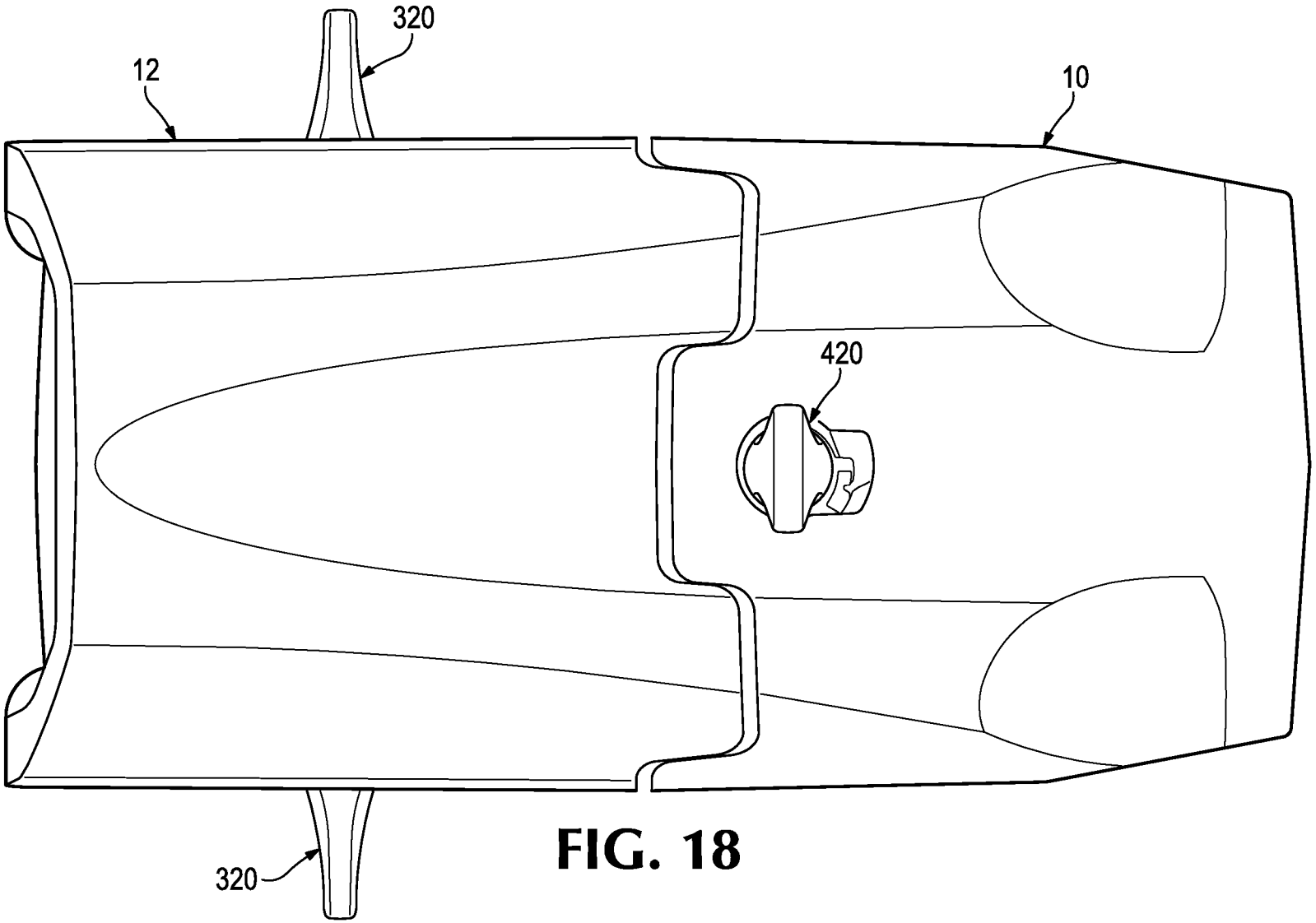
FIG. 18 is a top view of an example wear assembly including an intermediate adapter and wear member with two embodiments of lifting eyes installed for removing the intermediate adapter and wear member together.

In an alternative embodiment (FIGS. 17 and 18), connector 420 is similar in many ways to connector 320 with many of the same benefits and purposes. The following discussion focuses on the differences and does not repeat all the similarities that apply to connector 420. Connector 420 is primarily used during the removal of a wear assembly but in some cases may be used for installing a wear assembly as well. Lifting connector 420 includes a head 447 and a base 449. In one example, connector 420 is in the form of a lifting eye and base 449 is in the form of a shank (FIGS. 17 and 18). Head 447 comprises a load bearing ring 450 extending upward from base 449 for receipt of and connecting to approved rigging for lifting equipment (not shown).

Base 449 extends downward from head 447. Preferably threads 454, or another means for positively engaging the wear part, extend along the length of base 449. Threads may extend the entire length of base 449 or along only a portion of the base 449. In this embodiment, a lower portion 460 of base 449 is designed to extend into hole 66 to prevent removal of the wear member (like the designed lock for the wear member) so that a wear member and an intermediate adapter can be removed together as one piece. The threads define bearing surfaces that engage complementary threads in the hole in the wear part. The threads and the detent or latch cooperate to releasably hold the lifting connector in a generally immovable position with respect to the wear part. Connector 420 could also be used in conjunction with connector 320 to remove a wear member 10 and an intermediate adapter 12 (FIG. 18.), an intermediate adapter and adapter, or other combinations of wear parts.

Figure 19:
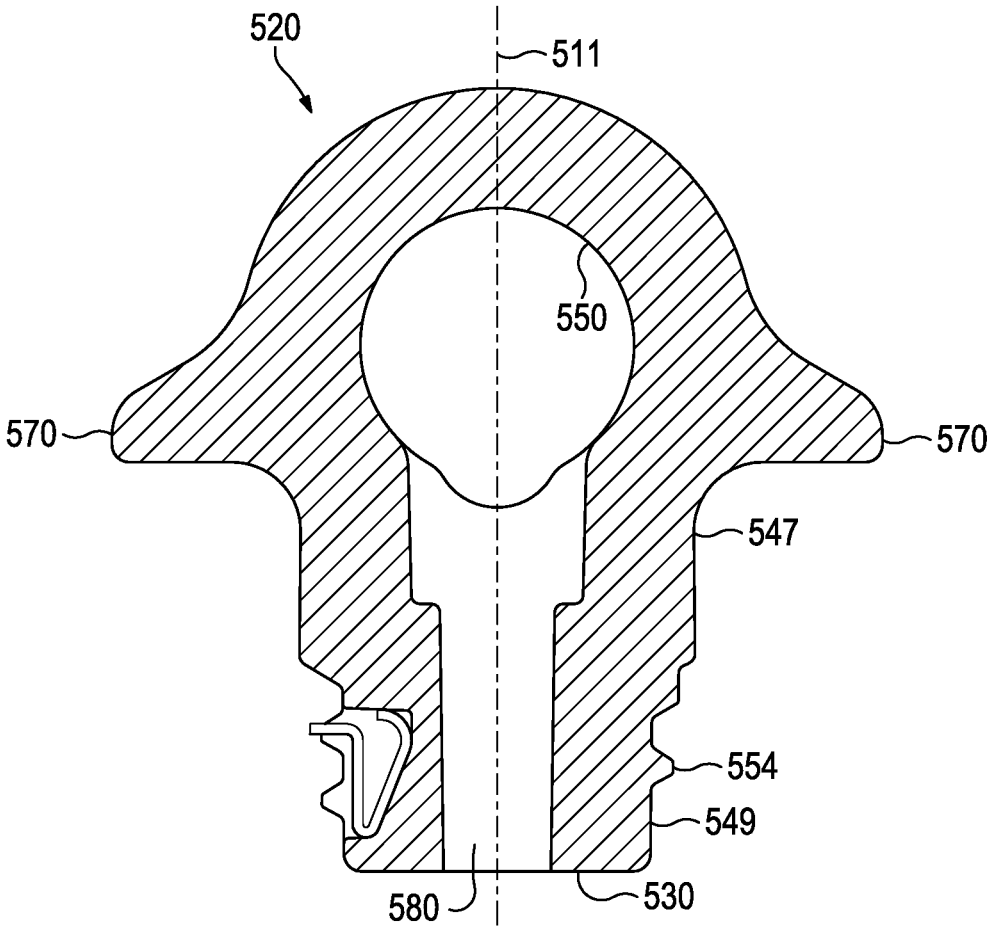
FIG. 19 is a cross-sectional view of another alternative connector of the present invention in the form of a lifting eye.

In an alternative embodiment (FIGS. 19-20), connector 520 is similar in many ways to connector 320 with many of the same benefits and purposes. Connector 520 is primarily used during the installation of a wear part but in some cases may be used for removing a wear part as well. Connector 520 includes a head 547 and a base 549. In one example, lifting connector 520 is in the form of a lifting eye with a shank (FIG. 19). Head 547 comprises a load bearing ring 550 extending upward from base 549 for receipt of and connecting to approved rigging. In one example, the load bearing ring 550 contains protrusions 570 on the front and rear of the connector. In this embodiment, one protrusion 570 faces the digging edge and one protrusion 570 faces the attachment end of the wear part. Protrusions 570 are designed to give a smooth transition between connector 520 and the wear member when the parts are assembled to ease the flow of material into, for example, an excavating bucket. This embodiment is particularly useful when the connector is used to install the wear part onto the excavating equipment.

Base 549 extends downward from head 547. Preferably threads 554, or another means for positively engaging the wear part, extend along the length of base 549. In this embodiment, base end 530 contains hole 580 extending upward along axis 511. Hole 580 could be any number of various shapes such as square, rectangular, hexagonal, cross, and the like. Hole 580 could be filled with a means to prevent fines from entering the hole once head 547 is worn away as will be discussed below. Alternatively, base 549 may have a blind hole or a through-hole extending along axis 511. The blind hole may extend upward from base end 530 or the blind hole may extend downward from ring 550 of head 547.

Figure 23:
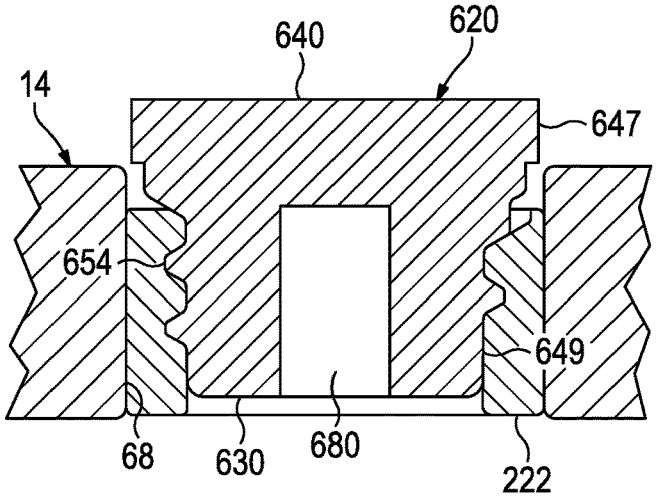
FIG. 23 is a partial cross-sectional view of a blade and one embodiment of a plug installed in a preexisting hole.

In an alternative embodiment (FIG. 23), a plug 620 is similar in many ways to connector 520 with many of the same benefits and purposes. Plug 620 includes a head 647 and a base 649. Plug 620 minimizes the amount of fines that can enter holes 67 and/or 68 when a connector or locking pin is not in use. In one example, head 647 has a flat surface 640 and base 649 is in the form of a shank (FIG. 23). Head 647 may have a blind hole extending down from flat surface 640. The blind hole could be any number of various shapes such as square, rectangular, hexagonal, cross, and the like for inserting a tool for installation and removal of the plug. Plug 620 could be made out of various materials and could, for example, be plastic, metal, or a resilient member.

Base 649 extends downward from head 647. Preferably threads 654, or another means for positively engaging the wear part, extend along the length of base 649. In this embodiment, base end 630 contains a blind hole or through-hole 680. Blind hole 680 could be any number of various shapes such as square, rectangular, hexagonal, cross, and the like. Blind hole 680 could be filled with a means to prevent fines from entering the hole once head 647 is worn away as will be discussed below.

Figure 24:
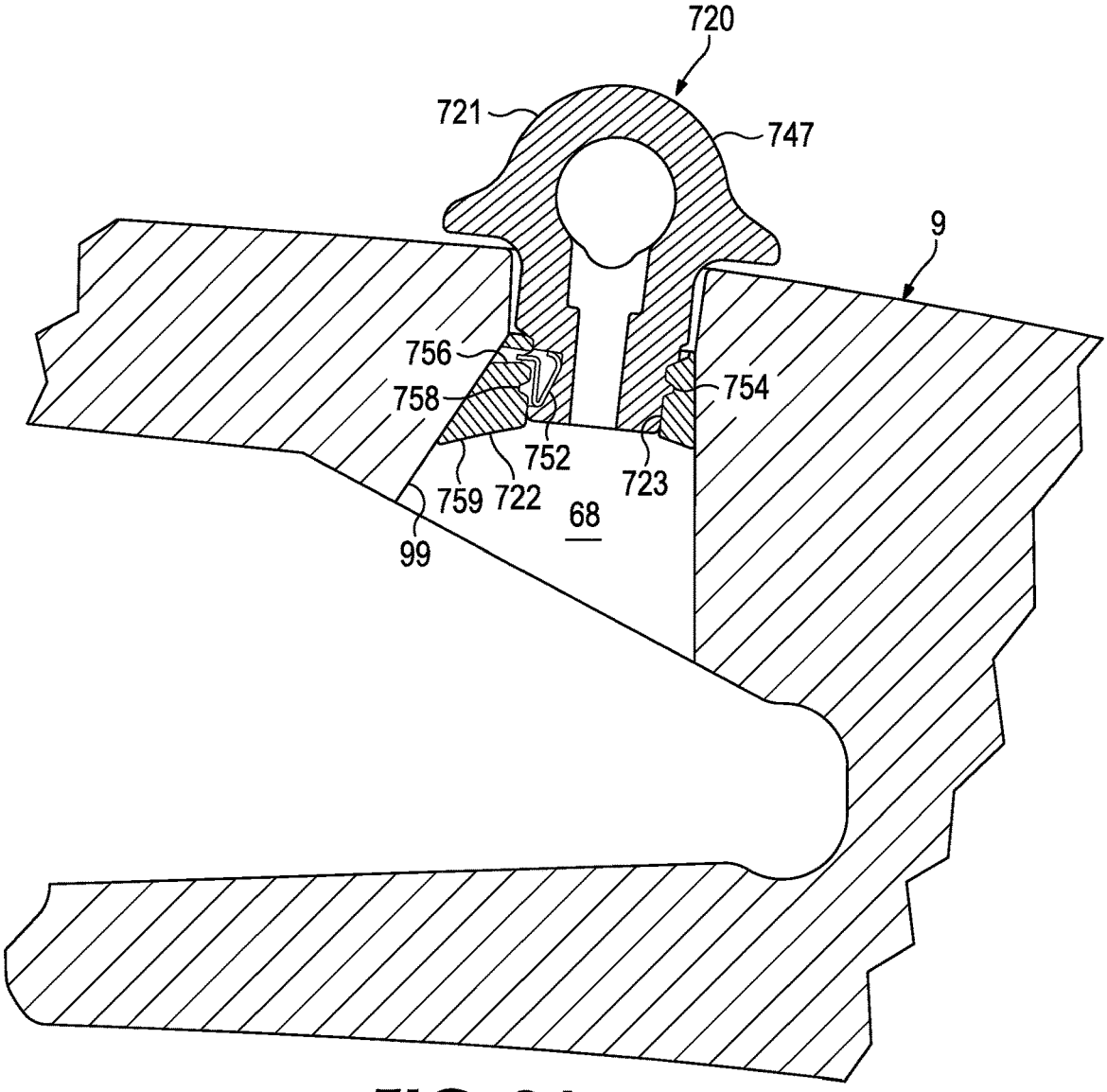
FIG. 24 is a partial cross-sectional view of a wear member and another alternative connector of the present invention in the form of a lifting eye.

In some embodiments the wear part will not be provided with a collar that is integrally installed as a part of the wear part. In this case, a mechanical connector 720 may be an assembly comprising a lifting component 721 and a collar 722 for securing the lifting component to the wear part (FIG. 24). In this embodiment, the wear part is shown as an adapter 9. The lifting component 721 is similar to connector 520 having many of the same features and benefits. Depending on the application, in alternative embodiments, the lifting component 721 may be similar to connector 320 or 420 having all of the same features and benefits (not shown).

Collar 722 includes a bore or opening 723 with a securement mechanism 758. In the example shown, the securement mechanism in the form of threads for receiving complementary threads 754 on the lifting component. Collar 722 also includes a protrusion 759 for engaging a sloped wall 99 adjacent hole 68 in wear member 10. The protrusion 759 prevents the collar from spinning. In alternative embodiments, the collar 722 may be similar to collar 222.

To install connector 720 collar 722 is first placed in hole 68 in the wear member so that protrusion 759 abuts sloped wall 99. Next, the lifting component 721 is installed in the collar 722 so that threads 754 on the lifting component engage the threads 758 on the collar. Lifting component 721 is rotated until the latching detent 752 of the lifting component 721 engages the latching formation 756 of the collar 722. At this point the lifting connector 720 is secured to the wear part with the head 747 of the lifting component 721 secured in a preferred orientation.

In use, the various connectors disclosed can be used alone or in conjunction with each other to install and remove wear members, intermediate adapters, adapters, shrouds, plates and the like. The wear parts can be removed individually or in partial assemblies. In addition the mechanical lifting connectors may be installed in the wear parts at the time of manufacture so that it can be shipped, stored, and installed as an integral unit with the wear part, i.e., with the lifting connector maintained in the preferred orientation so that the wear part is ready to be lifted with the mechanical lifting connector. Such a construction reduces inventory and storage needs, and eases the installation of the wear part. Nevertheless, if desired, the lifting connector could be shipped separately from the wear part.

In one example, connector 520 (or 320, or 720) could be installed into a hole 68 in wear member 10 specifically designed for receipt of the connector or into the hole provided for the lock. Wear member 10 is lifted by attaching connector 520 to approved rigging equipment and to a lifting device. In this example, a wear member 10 in the form of a point or tip is maneuvered onto intermediate adapter 12. Preferably, while wear member 10 is still secured to connector 520 (i.e., in hole 68) and the approved rigging equipment, locking pin 220 is installed in hole 67 of wear member 10 until locking pin 220 is fully engaged with intermediate adapter 12

In another example, wear member 10 and intermediate adapter 12 are installed and removed as an assembly. Wear member 10 and intermediate adapter 12 are assembled and secured with one or more locking pins 220. Alternatively in some cases, connector 420 could be used in place of locking pin 220 to connect a wear assembly for installation and removal. One or more connectors 320, 420, and/or 520 are installed into preformed holes in wear member 10. Preferably, two or more connectors 320 and/or 520 are installed into locking holes 67 on intermediate adapter 12. The wear member 10 and intermediate adapter 12 secured together by locking pins 220 or lifting connectors 420 are lifted as an assembly with connectors 320, 420, and/or 520, approved rigging, and a lifting device. The assembled wear parts are maneuvered to a nose or adapter secured to the lip of a bucket. The intermediate adapter is slid onto the nose or adapter. Preferably, while the wear parts are still secured to lifting equipment, one connector 320 or 520 is removed from the intermediate adapter and a locking pin 220 is installed in its place (i.e., the same securement mechanism of the wear part is utilized to hold the lifting connector 320 or 520 within hole 67 and utilized to hold the lock 220 within hole 67; similarly, the same latching formation within the hole 67 of the wear part is utilized to maintain the connector 320 or 520 in the proper service position and utilized to maintain lock 220 in the proper install and lock positions). Once one locking pin 220 secures intermediate adapter 12 to the nose or adapter the remaining connectors 320, 420, and/or 520 can be systematically removed one at a time and additional locking pins 220 can be installed in their place. In this way the wear part is always secured during the installation process reducing the likelihood that intermediate adapter 12 will fall off the adapter or wear member 10 will fall off intermediate adapter 12 prior to the locking pins being installed. The removal process for dissembling wear member 10 and intermediate adapter 12 from the adapter is similar to the installation process but in reverse order.

Figure 20:
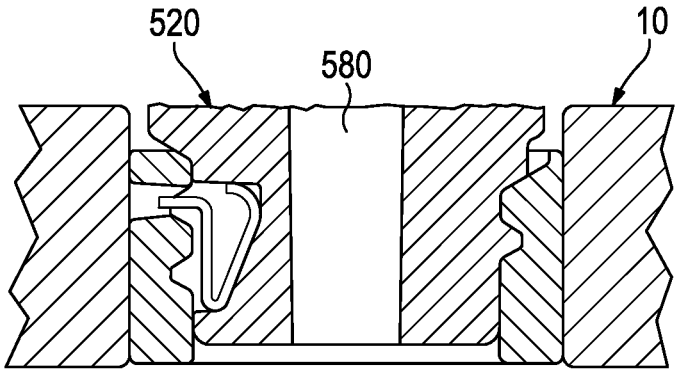
FIG. 20 is a partial cross-sectional view of a worn wear member and a worn connector from FIG. 19.

In some cases, after the wear parts have been assembled connector 520 is not removed. Leaving connector 520 installed in the wear part helps minimizes the amount of fines that can enter the hole. As the wear parts contact the ground the head 547 of connector 520 is worn away so that hole 580 becomes accessible with a tool. As can be seen in FIG. 20 which illustrates wear member 10 with a worn connector 520. In the case where hole 580 is a blind hole extending from the base end 530 inward toward the head (not shown), the connector is worn down until the hole is exposed, A tool that matches the shape of hole 580 is used to remove the worn connector 520. A new connector such as connector 320 or 520 can be installed into the hole within the wear part and connected to approved rigging and a lifting device. The lock securing the wear parts is removed. The wear part connected to the lifting device is separated and removed from the wear part secured to the excavating equipment.

In another case after one or more connectors have been used to install a plate 14 onto excavating equipment, one or more plugs 620 are installed in holes 67 and/or 68 (FIG. 23). Plate 14 may be, for example, a blade, a cutting edge, or a wear plate. Plug 620 minimizes the amount of fines that enter the holes 67 and/or 68. As the blade contacts the ground the head 647 of plug 620 is worn away so that hole 680 is exposed. Once blade 14 is ready for removal, a tool that matches the shape of blind hole 680 is used to remove the plugs 620. Connectors such as connectors 320 and/or 520 can be installed into the hole within the blade and connected to approved rigging and a lifting device. The blade which is secured to the lifting device is separated and removed from the excavating equipment.

The above disclosure describes specific examples of connectors and methods for removing worn wear parts that include different aspects or features of the invention. The various inventive features are preferably used together in ways as described in the embodiments. Nevertheless, the various features can be used alone and still gain certain benefits of the invention. For example, connectors with a base that positively engages a worn wear part having a lifting head can be used and the benefits gained regardless of whether they are combined with other inventive features such as latching detents, threads, blind holes, and the like. This could be the case for each of the inventive features disclosed. Also, features in one embodiment can be used with features of the other embodiment. The examples given and the combination of features disclosed are not intended to be limiting in the sense that they must be used together.

The invention claimed is:

1. A wear part for use with earthmoving equipment, comprising, a wearable surface, a hole formed in the wear part, a mounting configuration to mount the wear part on the earthmoving equipment, the mounting configuration being at least partly complementary in shape to that of a confronting mounting surface associated with the earthmoving equipment, and a lifting connector mechanically attached to the wear part, the lifting connector having a head to facilitate connection with a lifting device and a base having a latching formation to releasably prevent the base from turning in the hole.

2. A wear part in accordance with claim 1 wherein the lifting connector is shipped, stored, and installed as an integral unit with the wear part.

3. A wear part in accordance with claim 1 wherein the latching formation engages a corresponding latching formation in the wear part to hold the lifting connector in a proper service position.

4. A wear part in accordance with claim 1 wherein the latching formation of the base of the lifting connector has a latching tooth to engage the wear part to maintain the head in the proper service position.

5. A wear part in accordance with claim 1 including a collar inserted and held in the hole in the wear part, the collar having an opening for receiving the base.

6. A wear part in accordance with claim 1 including a collar insertable and releasably held in the hole in the wear part, the collar having an opening for receiving the base and a recess in the opening, and wherein the base includes a latching formation to engage the recess in the collar to releasably prevent movement of the base relative to the collar.

7. A wear part in accordance with claim 1 wherein the lifting connector gives haptic and audible feedback once the connector is in a proper service position.

8. A wear part in accordance with claim 1 wherein the head is in the form of a ring.

9. A wear part in accordance with claim 1 wherein the base is a shank.

10. A wear part in accordance with claim 9 wherein the shank has threads to form a positive engagement with corresponding threads on the wear part.

11. A wear part in accordance with claim 1 wherein the lifting connector is configured to support and facilitate lifting of the wear part free of other connections between the wear part and a lifting device.

12. A wear part in accordance with claim 1 wherein the wear part is a point.

13. A wear part in accordance with claim 1 wherein the wear part is an intermediate adapter.

14. A wear part in accordance with claim 1 wherein the wear part is an adapter.

15. A wear part in accordance with claim 1 wherein the wear part is a shroud.

* * * * *